United States Patent [19]

Nystuen et al.

[11] Patent Number: 4,782,544

[45] Date of Patent: Nov. 8, 1988

[54] WATER EXTRACTION METHOD AND CONTROL FOR AUTOMATIC WASHER

[75] Inventors: Arne M. Nystuen, Lincoln Township, Berrien County; David W. Mundy; John M. Kuss, both of St. Joseph Township, Berrien County, all of Mich.

[73] Assignee: Whirlpool Corporation, Benton Harbor, Mich.

[21] Appl. No.: 39,321

[22] Filed: Apr. 16, 1987

[51] Int. Cl.[4] ..... D06F 33/02

[52] U.S. Cl. ..... 8/159; 68/12 R; 68/23 R

[58] Field of Search ..... 8/159; 68/12 R, 23 R

[56] References Cited

U.S. PATENT DOCUMENTS

| | | | |
|---|---|---|---|
| 2,795,902 | 3/1961 | Pinder | 210/144 |
| 3,403,538 | 10/1968 | Andrew et al. | 68/12 R |
| 3,425,559 | 2/1969 | Sisson | 68/12 R X |
| 3,526,105 | 9/1970 | Anthony | 68/12 R |
| 4,195,500 | 4/1980 | Tobita et al. | 68/12 R |
| 4,235,085 | 11/1980 | Torita | 68/12 R |
| 4,513,464 | 4/1985 | Rettich et al. | 68/12 R X |
| 4,607,408 | 8/1986 | Didier et al. | 8/159 |
| 4,679,414 | 7/1987 | Takimoto et al. | 68/12 R |

FOREIGN PATENT DOCUMENTS

| | | | |
|---|---|---|---|
| 2153858 | 5/1973 | Fed. Rep. of Germany | 68/12 R |
| 2170518 | 8/1986 | United Kingdom | 8/159 |

*Primary Examiner*—Philip R. Coe

*Attorney, Agent, or Firm*—Hill, Van Santen, Steadman & Simpson

[57] ABSTRACT

A method and control for an automatic washer is provided in which moisture extraction from a fabric load is controlled by extracting the moisture at increasingly faster levels of basket rotation. Initially the basket is rotated relatively slowly and it is subsequently rotated at successively faster speed levels, each increase occurring after substantially all of the moisture has been removed which is removable at a given speed level. Inertia of the fabric load is measured to determine the amount of incremental moisture removal. Use of such a method substantially reduces the force applied to the fabric load during the centrifugal extraction resulting in less wrinkling of the fabrics.

37 Claims, 4 Drawing Sheets

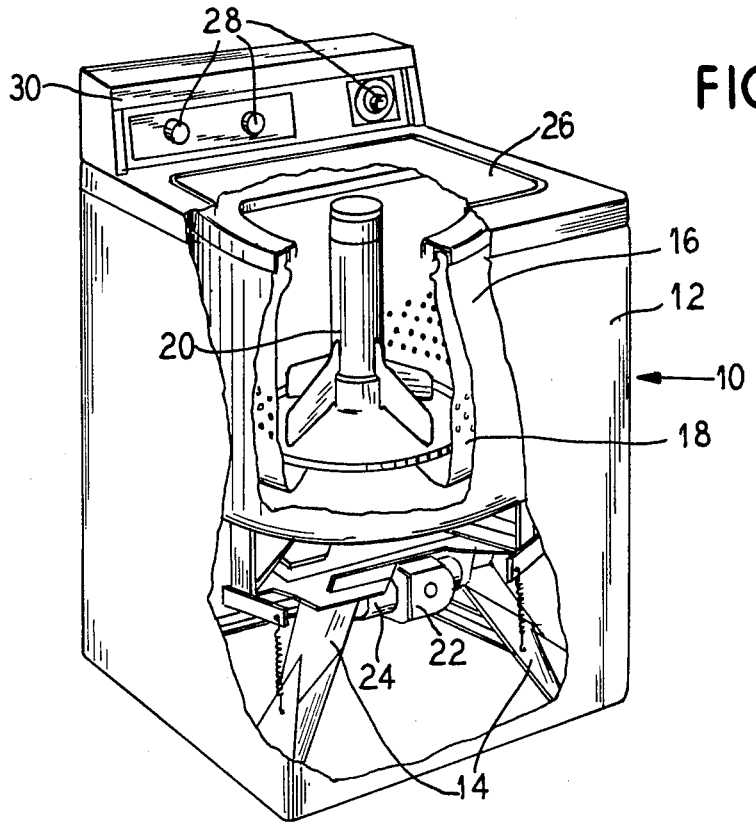
FIG. 1
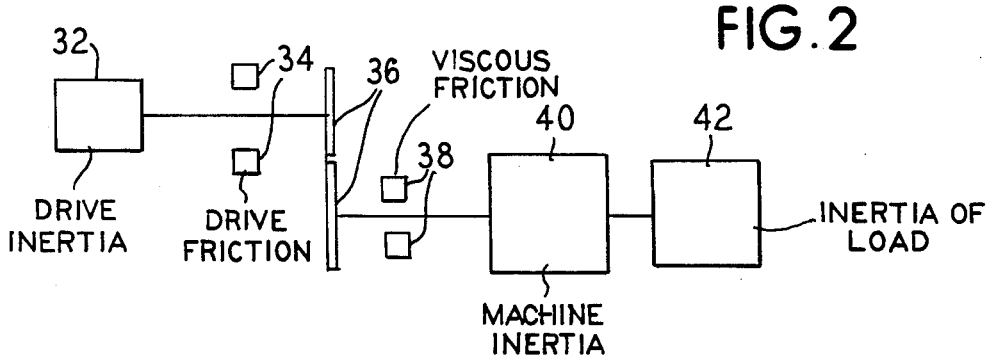
FIG. 2
FIG. 3
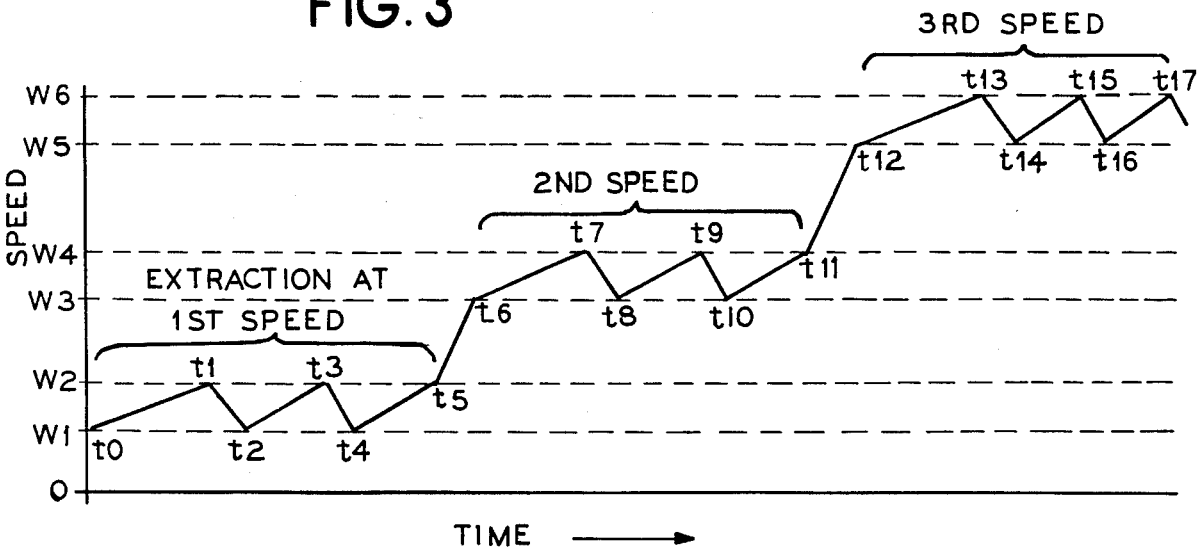

WATER EXTRACTION METHOD AND CONTROL FOR AUTOMATIC WASHER

BACKGROUND OF THE INVENTION

1. Field of the Invention

The present invention relates to a control and method for extracting water from a clothes load within an automatic washer.

2. Description of the Prior Art

At the end of a wash cycle in an automatic washer there is a water extraction step in which normally the wash basket is rotated about its axis to cause water carried within the clothes load to be extracted by centrifugal force.

The speed at which the clothes basket is spun is a balancing of several factors. First, as high a speed as is feasible is desired in order to provide maximum extraction of the water from the clothes so that less energy is required in a subsequent drying step in the wash process. A number of factors enter into placing a ceiling or upper limit on the spin speed including the important consideration of attempting to avoid excessive wrinkling of the clothes, particularly permanent press type clothing. Wrinkling of the clothes is increased when the clothes are spun at a very high rotational rate. Automatic washing machines manufactured by Whirlpool Corporation, the assignee of the present application, have a top spin speed in the range of 600–700 rpm, in that it has been determined that higher spin speed causes excessive wrinkling.

A common prior art method of spinning the basket incorporates an AC motor which, through an appropriate transmission and gearing quickly accelerates the basket up to a constant speed level which is maintained throughout the entirety of the extraction step for a predetermined length of time.

Other types of extraction controls and methods are known in the art. U.S. Pat. No. 2,975,902 discloses a horizontal axis washer in which the spin speed is increased in small predetermined increments from a normal tumbling speed up to the speed at which the clothes become plastered against the drum wall in order to effect a desired distribution of the clothes around the drum wall. Once the clothes have become plastered against the wall, the spin speed is then increased rapidly to a maximum spin speed.

U.S. Pat. No. 3,403,538 discloses the use of a controlled spin operation in which the spin speed is prevented from rising above 300 rpm during a first phase of spin, but is permitted to increase to a speed between 300 rpm and 1000 rpm during a second phase of spin if an unbalanced load was not detected as the spin tub passed through its critical speed. If an unbalanced condition is detected as the spin tub passes through critical speed, the spin speed is maintained below 300 rpm.

U.S. Pat. No. 3,425,559 discloses an automatic washer having a single speed motor and a two-speed transmission, along with control means for maintaining the transmission and low speed setting during the initial portion of the spin to reduce the load of the motor. Once the motor speed reaches a certain percentage of its maximum speed, the transmission is shifted into its high speed mode, thereby increasing the spin speed to its maximum. This is done to prevent stalling of the motor at the start of a spin cycle of operation.

U.S. Pat. No. 3,526,105 discloses the desirability of keeping the spin speed low to maintain good performance when laundering permanent press fabrics. The disclosed control operates a pump at high speed during an extraction portion of the wash cycle and operates the motor, which effects rotation of the fabric basket, at a high speed until a portion of the liquid has been removed, which is sensed by a level sensing switch, at which time the motor will be energized at a slower speed through the remainder of the extraction portion of the cycle. It is stated that the full tube of water prevents high rotation speed of the inner basket when the motor is energized at a high speed.

U.S. Pat. No. 4,513,464 discloses the idea of providing controlled acceleration to the drum of a centrifugal extractor to minimize unbalance problems. In particular, the speed of the drum is held constant until the amount of load unbalance drops below a certain level, after which the speed is increased and the unbalance is again measured. This patent also discloses the idea of measuring the difference between successive unbalance measurements, for the purpose of controlling the speed of the drum.

SUMMARY OF THE INVENTION

The present invention provides a method and control for extracting water in an automatic washer in which the speed of rotation is started out at a low level and is incrementally increased, to reduce the amount of wrinkling in the clothes load while eventually obtaining as high or higher level of moisture extraction as has been common in the past. In a preferred embodiment, the basket is spun at a low speed level until all of the moisture extractable at the low speed level has been extracted and then the basket is spun at a somewhat higher speed level, again until all of the moisture that can be extracted at the higher speed level has been extracted. This process of incrementally increasing the spin speed is continued until a desired level of moisture extraction has occurred.

The extent of liquid extraction at each speed level is measured by sensing and comparing successive basket acceleration times. That is, at each speed level, the basket is caused to accelerate and decelerate repeatedly, between a low limit speed and a high limit speed, and the duration of each successive acceleration step is measured, while a constant motor torque is applied to the basket. The amount of water extracted since the previous acceleration is indicated by a difference in the time required to achieve the high limit speed, the difference in times between successive steps being caused by a difference in the inertia of the clothes load, and the change of inertia being directly related to the amount of water extracted. Thus, when acceleration times are equal between successive acceleration steps, no additional water will have been extracted. When equal acceleration times are sensed, the control then causes the motor to operate at the next higher rotational speed level or range, between a preset lower limit and a preset upper limit speed. Again, the motor is periodically accelerated from the low limit to high limit speeds and is caused to decelerate again to the low limit speed so that successive acceleration times may be measured.

By use of the present invention, the force applied to the clothes within the basket during spin is considerably reduced, particularly during the early stages of the spin cycle thus providing enhanced performance and reduced wrinkling.

By use of the present invention, the spin cycle can be terminated when the desired level of water extraction has been sensed, which time is related specifically to the particular clothes load being laundered rather than a preset and predetermined time period. Thus, by use of the present invention, a water extraction level equal to the presently achievable extraction level can be obtained while applying a substantially lower force on the clothes load thus resulting in considerably less wrinkling of the clothes. Further, a higher level of extraction can be achieved than is available in the present commercial production models while again applying a lesser force on the clothes load and thus a reduction in the wrinkling.

BRIEF DESCRIPTION OF THE DRAWINGS

FIG. 1 is a perspective view of an automatic washer in which the principles of the present invention can be employed.

FIG. 2 is a schematic illustration of the inertia loads in the drive system of the washer of FIG. 1.

FIG. 3 is a graphic illustration of rotational speed of the basket during an extraction process embodying the principles of the present invention.

DESCRIPTION OF THE PREFERRED EMBODIMENTS

Figure 4:
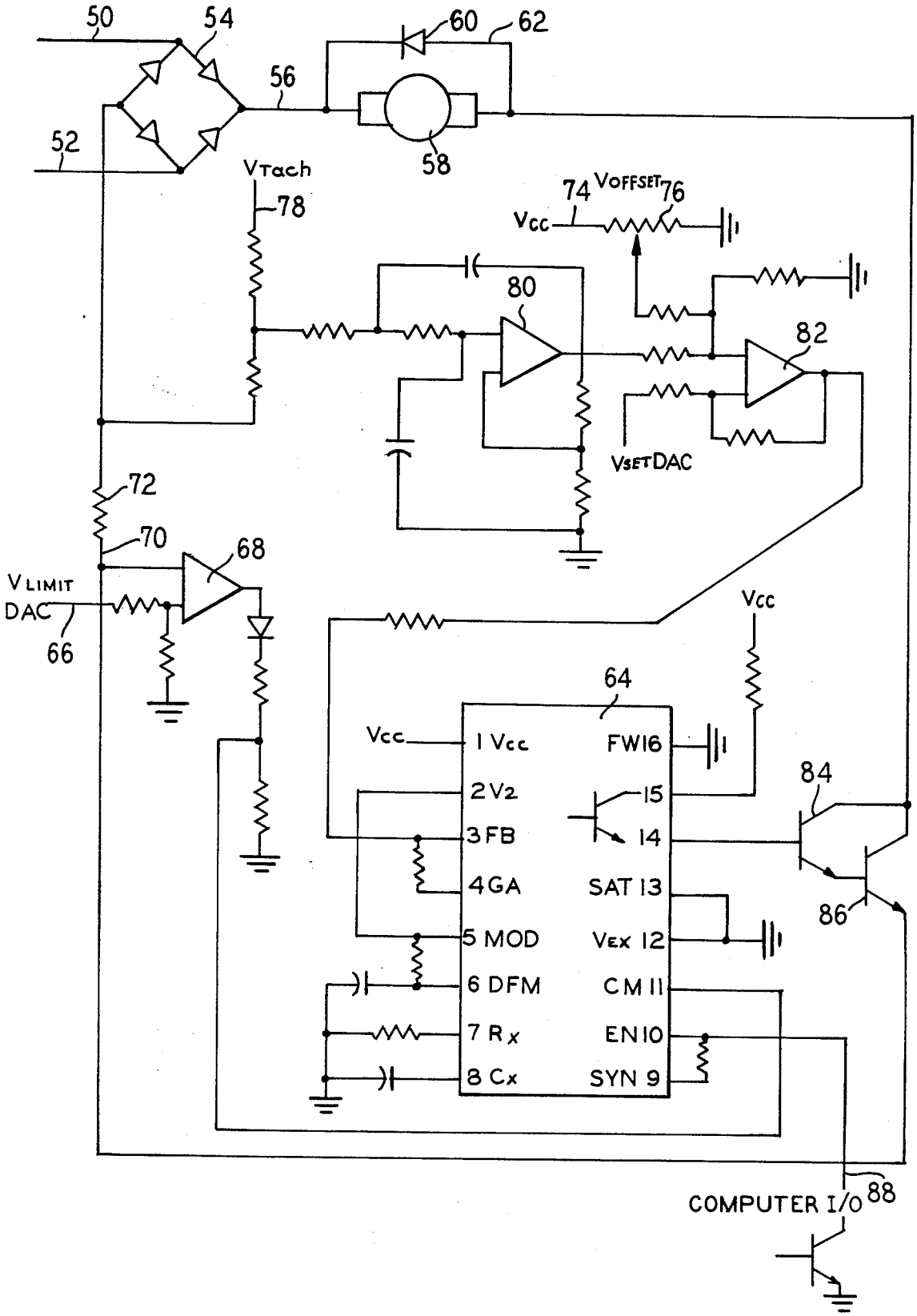
FIG. 4 is a schematic illustration of an automatic washer control for operating a motor in accordance with the principles of the present invention.

In FIG. 1 there is illustrated a vertical axis washer generally at 10 having an outer cabinet 12 enclosing a washer mechanism supported on legs 14. The washer mechanism includes an imperforate wash tub 16 with a concentrically carried perforate wash basket 18 and a central vertical axis agitator 20. The agitator 20 and basket 18 are driven by means of an electric motor 22 through an appropriate transmission 24.

The interior of the wash basket 18 is accessed through an openable lid 26 and a plurality of manually operated controls 28 are provided on a console 30 at a top rear of the washer 10. During a water extraction portion of the wash cycle the perforate basket 18 is rotated about its vertical axis to cause water contained within the clothes load to be forced outwardly through the perforate wall of the basket by centrifugal force.

FIG. 2 schematically illustrates sources of inertia in the moving parts of the washer during the spin extraction portion of the wash cycle. Box 32 signifies the inertia of the motor and drive shaft of the motor. Boxes 34 represent drive friction primarily in the bearings of the motor and drive shaft. Boxes 36 represent the gears connecting the motor with the basket which can comprise either a direct gear connection or a belt and pulley connection. Boxes 38 represent bearing friction associated with the basket and agitator and box 40 represents the inertia of the machine, that is inertia of the basket, agitator and spin tube. Finally, box 42 represents inertia of the load carried within the basket. During a spin operation, the inertia of the elements represented by boxes 32 through 40 remains constant at any given rotational speed. Only the inertia of the load, represented by box 42, changes during a spin operation. This inertia changes because the amount of water retained in the load decreases during spin. If the inertia of the load 42 does not change within a given time period then this means that the amount of water extracted has not changed.

The present invention utilizes this changing inertia of the load as a means for detecting the amount of water extracted during any given time period.

FIG. 3 illustrates one embodiment of the invention in a graphic form depicting rotational speed of the basket versus time. A first low limit speed W1 and a first high limit speed W2 for the basket are predetermined. The motor is energized to accelerate the basket up to the first lower limit speed W1 as an initial starting point. Then, the basket speed is accelerated from the first low limit speed W1 to the first high limit speed W2 and the time required to accelerate to the first high level speed W2 is measured. This is represented by times $T_o$ as the initial time and $T_1$ as the final time. The basket speed is then allowed to declerate down to the initial low limit speed W1 and, upon achieving that speed, is again accelerated up to the high limit speed W2. Again the time required for such acceleration is measured, this being the time between points $T_2$ and $T_3$. The two time periods, that is $T_3 - T_2$ and $T_1 - T_o$ are compared and, if significantly different, the basket is caused to decelerate again to the initial low limit W1 where it is again accelerated up to the high limit W2 and the time required for acceleration measured. The new time period $T_5 - T_4$ is compared with the most recent measured time period, that is $T_3 - T_2$ and, if there is a significant difference, the same steps would be repeated.

In the illustration of FIG. 3, the two time periods $T_5 - T_4$ and $T_3 - T_2$ are substantially identical, thus indicating that the acceleration time is the same and, therefore indicating that the inertia of the load is the same. This is known because the torque applied by the motor during each acceleration step is held constant. The basket is then caused to accelerate up to a new low limit speed W3 as an initial point from where it is accelerated up to a new high limit speed W4 and the time required for such acceleration, $T_7 - T_6$ is measured. Again, the basket is then caused to decelerate to the new low limit speed W3 from where it is caused to reaccelerate up to the high limit speed W4. The same steps are repeated as were done during the extraction at the first speed range, that is, the acceleration times compared for successive accelerations between the low limit speed and high limit speed until two successive speeds are detected that are not significantly different. When such a determination occurs the motor accelerates the basket to a third speed range defined between a low limit speed W5 and a high limit speed W6 and the same steps are again undertaken.

In this manner, the clothes load is first rotated at a relatively low first speed level until virtually all of the moisture extractable at that rotational speed level has in fact been extracted. Only then is the basket accelerated up to a second speed level and maintained at that level, until virtually all of the moisture extractable at that speed level has been extracted. Such an incremental increase in speed levels is continued until a predetermined speed level is attained which represents a desired level of moisture extraction. Once it has been determined that all of the moisture has been extracted at the predetermined highest speed level, then the spin step of the wash cycle is terminated.

FIG. 4 illustrates circuitry which can be utilized as a control for achieving the various levels of low limit and high limit speeds of the motor as illustrated in FIG. 3. A source of alternating current is supplied to lines 50, 52 which are connected to a full wave bridge rectifier 54 to provide a DC voltage on line 56 to a motor 58. A diode 60 is provided on a bypass line 62 to prevent a reverse current flow through the DC motor.

It is desired during the operation of the motor to rotate the motor shaft at a series of preselected speeds defining a speed range at various speed levels. Further, it is desired to supply a fixed current to the motor at any given speed level so that the torque of the motor is held constant to permit a consistent measurement of acceleration times of the motor. The control of the motor is provided by use of a pulse width modulator control circuit 64 such as Model CS-5560 produced by Cherry Semiconductor of East Greenwich, R.I.

To provide a desired current level, a voltage source $V_{limit\ DAC}$ is applied at line 66 to one leg of a comparator 68 while the other leg of the comparator is connected to a line 70 which, through a relatively small resistance 72 thereby measuring the current flowing to the motor. The comparator 68 acts as a switch and, the output signal of the comparator is supplied to port 11 of the control circuit 64 which is a current limiting port which affects the output of the control circuit at port 14. The voltage supplied at line 66 can be set at a relatively high amount to initiate the spinning program in order to overcome the initial at rest inertia of the wash basket and clothes load to bring the wash basket up to a first minimum rotational speed. Thereafter, the voltage can be reduced such that a lower current is supplied to the motor for the various acceleration steps. It is not necessary that the current supplied to the motor at various speed levels be maintained constant, however it is necessary for the current level supplied to the motor to remain constant at a given speed level.

A reference voltage $V_{cc}$ is utilized at a number of locations in the circuit, being supplied to port 1 as a reference voltage for the control circuit 64, through a resistance to port 15 and to provide an internal voltage at line 74 to a potentiometer 76 used in determining the rotational speed of the motor shaft. In the embodiment of the circuit illustrated in FIG. 4, a voltage $V_{tach}$, which may be obtained as an output voltage of a tachometer attached to the motor shaft, is applied to line 78 and which passes through an amplifier and filter circuit 80 and is summed with the reference voltage $V_{offset}$ at comparator 82. An alternate means of measuring the speed of the motor can be to tap directly into the back EMF of the motor rather than utilizing a separate tachometer.

A second leg of comparator 82 is supplied with a voltage $V_{set\ DAC}$ which is a voltage designed to set the particular rotational speed to be obtained by the rotating motor shaft. Thus, during operation at a given speed level, this voltage will be at a relatively low level when the motor is to be operating at the low limit rotational speed, and then when acceleration is to occur, the voltage level will be increased to represent the high limit speed at that level. Once the high limit speed is achieved, the voltage would be returned to the low limit value. This back and forth changing of the voltage limit would continue until the acceleration times have been determined to be approximately equal and then the voltage would be increased to the new, higher low limit value for the next highest speed level range. The output of comparator 82 is fed to feedback port 3 of the control circuit 64. The output of control circuit 64 comes from port 14 and is used to drive a powered darlington amplifier 84 which in turn drives a power transistor 86 to provide the current flow to the motor.

The entire control circuit 64 can be turned off by an appropriate signal on line 88 to port 10.

Thus, the circuitry of FIG. 4 illustrates one embodiment of a means for controlling the motor speed to operate the motor at various speed levels, between high and low limit speeds at those levels through an appropriate voltage signal $V_{set\ DAC}$ and to control the current to the motor through an appropriately selected voltage signal $V_{limit\ DAC}$. An external circuit such as a micro computer with a timer is utilized to measure the time required to accelerate from a given low limit speed to a given high limit speed at each speed level and is utilized to provide the desired voltage signals $V_{set\ DAC}$ and $V_{limit\ DAC}$.

Figure 5:
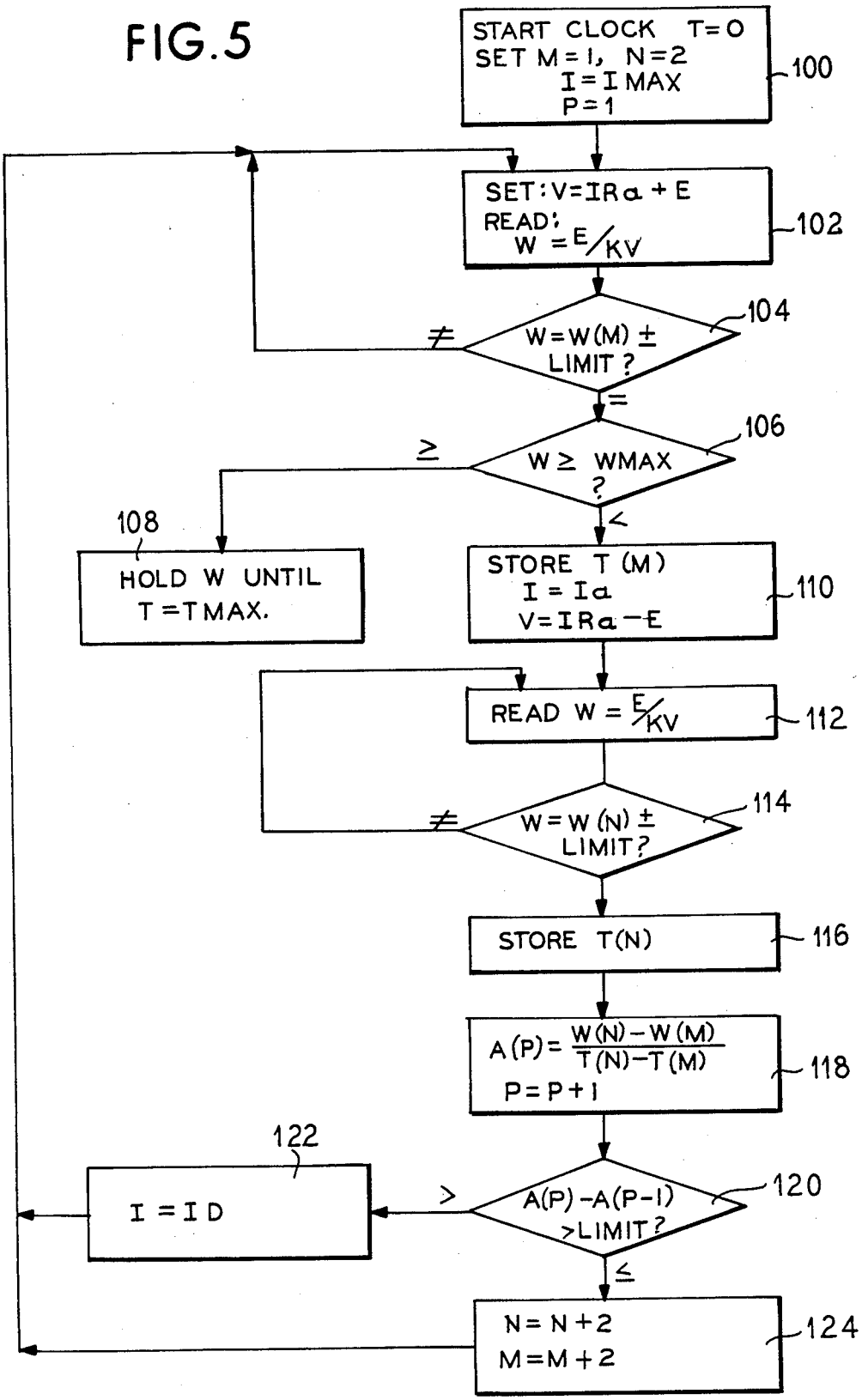
FIG. 5 is a flow chart illustration of the steps undertaken in a method embodying the principles of the present invention.

FIG. 5 is a flow chart diagram illustrating the steps undertaken during the method disclosed herein. In control unit 100 a clock is started at a time zero. The speed level set points are set for M representing a minimum speed at 1 and N representing a maximum speed at 2. A current level I is set at a maximum limit and a counter P is set at 1.

Control is then passed to control unit 102 where armature voltage is set at a level equal to current I times resistance of the armature Ra plus a voltage E equal to the back EMF voltage of the motor. Motor speed is then read and stored as variable W which equals the back EMF voltage E divided by a motor speed constant $K_v$. Control is then passed to control unit 104 where the read motor speed W is compared to a minimum speed W(M) plus or minus a predetermined range limit. If the read speed is not substantially equal to the minimum speed W(M) then control is passed back to control unit 102 for a repetition of the reading until the minimum speed is attained. When the minimum speed is attained, control is passed to control unit 106 where it is determined if the motor speed W is greater than or equal to the maximum speed of the motor $W_{max}$. If the motor speed is greater or equal to the maximum speed then control is passed to control unit 108 where the speed is held until a maximum spin time limit $T_{max}$ is reached.

As long as motor speed is below maximum speed, then control is passed to control unit 110 where the time at the minimum speed set point is stored as T(M), current I is set at an acceleration current $I_a$ and voltage is set at the current times the armature resistance plus the back EMF voltage of the motor. Control is then passed to control unit 112 where the motor speed W is read, as was done in control unit 102. Control is then passed to control unit 114 which compares the read motor speed with a maximum speed set point W(N) plus or minus a predetermined limit range. If the maximum speed set point has not been attained, control is passed back to control unit 112 for a repetition of steps in control unit 112 and 114 until the maximum speed set point is attained. Then control is passed to control unit 116 where the time at the maximum speed set point is stored as T(N). Control is then passed to control unit 118 in which acceleration at the current counter level P is calculated by the difference between the maximum speed set point W(N) minus the minimum speed set point W(M) divided by the time difference of the time at the maximum speed set point T(N) minus the time at the minimum speed set point T(M). The counter is then incremented by 1 and control is passed to control unit 120 which compares the current acceleration A(P) with the most recent acceleration A(P-1) to determine if the current acceleration is greater than a predetermined limit amount. If the difference is greater than the limit then control is passed to control unit 122 where current is set to a current level during deceleration $I_d$ and control is passed back to control unit 102 to repeat the above described steps.

However, if the current acceleration is within the predetermined limit amount of the most recent acceleration, then control is passed to control unit 124 where the minimum and maximum set points are incremented to the next higher level. Then control is passed back to control unit 102 to repeat the above steps for the new levels.

It is thus seen that the control will first bring the basket up to an initial speed and start a timer and then will cause the basket to accelerate and decelerate in a first speed range until accelerations of the basket in two successive acceleration steps are substantially the same. Then the control will increment the speed range to a next higher level and again there will be a repetition of acceleration and decelerations until a substantially constant acceleration is sensed.

Figure 6:
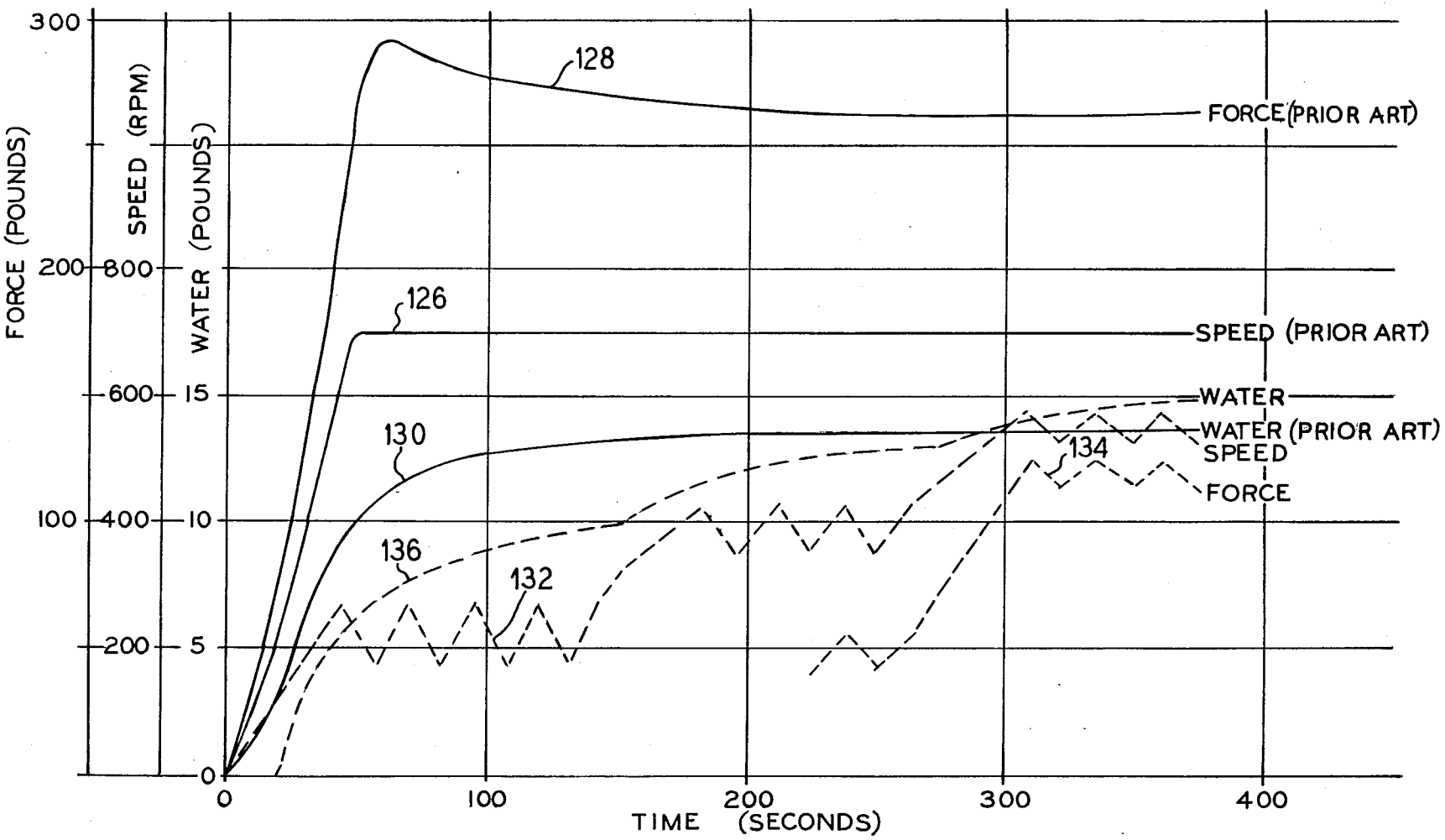
FIG. 6 is a graphic illustration comparing basket rotational speed, force applied to the clothes load and water extraction between the present available commercial washing machines and a washing machine embodying the principles of the present invention.

FIG. 6 graphically illustrates the significant improvement in operation provided by the present invention. This graphic illustration compares basket rotational speed, force on the clothes load and amount of water extraction which occurs in a presently available washing machine with identical parameters in a washing machine embodying the principles of the present invention.

Specifically, in the presently available washing machine the speed of the basket, which is illustrated by the line designated 126, is caused to rapidly accelerate from zero up to some predetermined constant rate of approximately 700 rpm and the speed remains relatively constant during the entire extraction cycle. The force on the clothes load is illustrated by line 128 and it is seen that it accelerates rapidly up to a peak amount just short of 300 lbs. from where it slowly tapers down to a level still above 250 lbs. The peak in the force curve occurs when the speed of the basket reaches its highest level and it slowly decreases due to water being extracted from the clothes load. That is, as more water is extracted, the force on the clothes decreases.

The amount of water extracted, in pounds, is illustrated by curve 130 which shows a fairly rapidly increasing amount of water being extracted as the speed of the basket accelerates towards its fixed upper speed and then the amount of incremental or additional water being extracted slowly tapers off until, at about 200–240 seconds, all of the water that is extractable has been extracted and the curve remains level. In the presently available washing machines, the extraction step is continued for a predetermined period of time, independent of the moisture retaining quality of the clothes load. Thus, as illustrated, often the cycle continues despite the fact that no additional moisture is being extracted.

The same parameters are illustrated for a washer incorporating the principles of the present invention. A speed curve is illustrated by a dashed line at 132 which shows a first acceleration up to a first speed range with a repetition of accelerations and decelerations resulting in a saw tooth speed curve at a first level, then an acceleration up to a second level with a second saw tooth representation and finally an acceleration up to a third level again with a saw tooth representation.

The force on the clothes load, as measured during tests of a washer supplied with a control similar to that described above resulted in relatively low force loads on the clothes, that is below a hundred pounds, up until the speed had achieved the third or highest level as illustrated by a dashed line 134.

The amount of water extracted is illustrated by dashed curve 136 which shows that the amount of water extracted accelerates fairly rapidly and then begins to taper off during the first speed level. When the speed is increased to the second speed level it again accelerates and then tapers off and, as the basket speed is moved to the highest level, the amount of water extracted again accelerates upwardly and tapers off as the speed is held in the third speed range.

A surprising result obtained by use of the present invention, and illustrated in this comparison is that although the speed of the basket is maintained below that of a speed attained in presently available washers, the amount of water extracted is actually higher while the force on the clothes load is held considerably below that of presently available machines. In the presently available machines the force on the clothes load remains at a very high level even when the water has been extracted to a large degree. However, by use of the present invention, the force is held at a relatively low level even though speed of the basket is increased to a relatively high level. This seemingly inconsistent difference in results is explained because in presently available machines, as the speed of the basket is rapidly accelerated to its final, constant level, the clothes are pressed against the basket wall by the weight of the water still remaining in the basket and, as a wet mass are virtually molded or plastered against the sidewalls of the basket. Even though the additional water is removed from the clothes, the clothes remain pressed tightly against the wall of the basket and, even after the basket has stopped rotating at the end of the cycle, the clothes are still pressed against the outside wall of the basket and must actually be peeled away from the basket wall. However, in a wash cycle embodying the principles of the present invention, most of the water is extracted from the clothes without the clothes being pressed tightly against the basket wall and thus, the force on the clothes never attains the high level experienced in present washers. An empirical observation of the appearance of the clothes within the basket at the end of the cycle shows that the clothes are not plastered against the sidewall of the basket, but look fluffier. This corresponds to a much lower force on the clothes load which translates into wrinkling of the clothes.

It can be appreciated that various other embodiments of the invention can be undertaken to provide the advantageous results described. For example, although the above embodiment is described as utilizing a permanent magnet brush motor (FIG. 4) in which the back EMF of the motor is sensed (FIG. 5), thereby requiring no external controls, the invention could also be incorporated by using a tachometer feedback. Also, an induction motor or an electronically commutated motor could be utilized instead of the permanent magnet motor described.

Also, a control could be employed to cause the basket to accelerate to a first rotational speed for a given time period, then accelerate to a second speed level for a predetermined time period and to higher levels of speed for given time periods in accordance with empirically predetermined test results to achieve a result substantially identical to that described above although exact precision would not be attained in assuring that all of the moisture had been extracted at a given speed level or that termination of the operation occurred as soon as the maximum amount of moisture had been extracted for the highest speed level. A further embodiment of the invention would be one in which the speed of the basket is slowly but constantly accelerated so that again most of the water would be extracted from the wash load at a relatively low basket speed, while permitting maximum moisture extraction by having a relatively high maximum basket rotational speed.

An alternative control could provide constant acceleration to the motor and measure the torque differences, rather than as discussed above by providing a constant torque and measuring the acceleration.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of extracting moisture from a fabric load in an automatic washer which has a rotatable wash basket comprising the steps:

rotating said basket at a first, low rotational speed level until all of the moisture removable at that rotational speed level has been removed;

increasing the rotational speed of the basket to a next, higher rotational speed level until all of the moisture removable at that rotational speed level has been removed; and repeating the prior step until a desired degree moisture removal has occurred.

2. A method according to claim 1, wherein a periodic sensing of incremental moisture removal is performed at each speed level to determine when all moisture removable at that speed level has been removed.

3. A method according to claim 2, wherein at each speed level said basket is repeatedly accelerated between a low limit speed and a high limit speed, the times for such accelerations measured and successive times compared to determine the incremental amount of moisture removal.

4. A method according to claim 3, wherein an electric motor is utilized to rotate said basket and a constant torque is applied to said basket by said motor during each acceleration at each speed level.

5. A method according to claim 3, wherein the increasing of rotational speed to a next, higher level occurs when the difference of two successive acceleration times is within a predetermined range.

6. A method according to claim 3, wherein said times for acceleration are measured by resetting a timer at an initiation of each acceleration and reading said timer at a termination of each acceleration.

7. A method of extracting moisture from a fabric load in an automatic washer which has a rotatable wash basket comprising the steps:

initially rotating said basket at a low spin speed level to begin removal of said moisture at said low speed level;

periodically sensing the amount of moisture removed;

incrementally increasing the speed of rotation of said basket to effectuate additional moisture removal from said fabric load until a predetermined condition determined from the measurement of removed moisture has occurred.

8. A method according to claim 7, wherein said basket is rotated at a plurality of defined speed levels, said basket rotational speed being incrementally increased between said defined levels.

9. A method according to claim 8, wherein said basket rotational speed is maintained at a given defined level until virtually all moisture removable at said defined level has been removed and then said rotational speed is incremented to a next higher defined level.

10. A method according to claim 9, wherein a periodic sensing of incremental moisture removal is performed at each speed level to determine when all moisture removable at that speed level has been removed.

11. A method according to claim 10, wherein at each speed level said basket is repeatedly accelerated between a low limit speed and a high limit speed, the times for such accelerations measured as successive times compared to determine the incremented amount of moisture removal.

12. A method according to claim 11, wherein a constant torque is applied to said basket during each acceleration at each speed level.

13. A method according to claim 7, wherein said rotational speed is slowly and continuously increased such that most of the moisture initially in said fabric load is removed prior to said basket achieving a maximum rotational speed.

14. A method of extracting moisture from a fabric load in an automatic washer which has a rotatable wash basket comprising the steps:

spinning said basket and periodically sensing the incremental amount of moisture removed; and terminating said spinning when said sensed incremental amount of moisture removed falls below a predetermined value.

15. A method according to claim 14, wherein said periodic sensing is performed by repeatedly accelerating said basket between a low limit speed and a high limit speed, measuring the time required for such accelerations and comparing successive required times to determine the incremental amount of moisture removed.

16. A method according to claim 15, wherein a constant torque is applied to said basket during each acceleration at each speed level.

17. A method according to claim 14, including the steps of increasing basket rotational speeds incrementally to a predetermined maximum speed, said incremental increases occurring when said sensed incremental amount of moisture removed falls below a predetermined value, and said termination of spinning occurring when said predetermined value is sensed at said maximum speed.

18. A method of extracting moisture from a fabric load in an automatic washer which has a rotatable wash basket comprising the steps:

(1) accelerating said basket from a low limit speed to a high limit speed, (2) measuring the time required for said acceleration, (3) decelerating said basket to said low limit speed,
(4) repeating steps 1 and 2, and
(5) comparing successive acceleration time to determine the extent of moisture extraction from said fabric load.

19. A method according to claim 18, including the steps of repeatedly increasing both the low limit speed and high limit speed incrementally when successive acceleration times are substantially equal and repeating steps 1 through 5 until a maximum high limit speed has been reached.

20. A method according to claim 19, including the step of terminating the rotation of said basket when successive acceleration times are sensed to be substantially equal at said maximum high limit speed.

21. A method according to claim 18, wherein said step of measuring the time required for said acceleration comprises resetting a timer at an initiation of each acceleration and reading said times at a termination of each acceleration.

22. A control for use in an automatic washer which has a rotatable wash basket driven by an electric motor comprising:

means for energizing said motor to rotate said basket at a first low speed level;

means for periodically sensing an incremental amount of moisture removed from a fabric load within said wash basket;

means for repeatedly increasing the rotational speed of said basket to a next higher speed level upon the occurrence of sensing an incremental amount of removed moisture below a preselected amount; and means for terminating the rotation of said basket when said increment amount of removed moisture is below a preselected amount at a predetermined maximum rotational speed level.

23. A control according to claim 22, wherein said means for periodically sensing an incremental amount of removed moisture comprises means for alternately accelerating and decelerating said basket between a low limit speed and a high limit speed at each speed level, means for measuring the time required for each acceleration and means for comparing successive acceleration times.

24. A control according to claim 22 wherein said means for periodically sensing an incremented amount of removed moisture comprises means for periodically measuring the combined rotational inertia of said wash basket and clothes load and means for comparing successive measurements.

25. A control means according to claim 24 wherein said means for periodically measuring the combined rotational inertia comprises means for periodically accelerating said basket with a constant torque and means for measuring said acceleration.

26. A control for use in an automatic washer which has a rotatable wash basket for receiving a fabric load driven by an electric motor comprising:

means for energizing said motor to rotate said basket;

means for alternately accelerating and decelerating said basket between a low limit speed and a high limit speed;

means for measuring the time required for each acceleration; and means for comparing successive acceleration times;

whereby, an incremental amount of moistured extracted can be determined.

27. A control according to claim 26, including means for cumulating determined extracted moisture extraction amounts to determine total moisture extracted.

28. A control according to claim 27, including means for terminating rotation of said wash basket upon said cumulated amount of extracted moisture reaching a predetermined level.

29. A control according to claim 26, including means for terminating rotation of said wash basket upon said incremental amount of extracted moisture being below a predetermined level.

30. A control according to claim 26, including means for incrementally increasing said low limit speed and said high limit speed upon said incremental amount of extracted moisture being below a predetermined level.

31. A control according to claim 30 including means for applying a constant torque to said basket during acceleration from each low limit speed.

32. A control for an automatic washer which has a rotatable wash basket for receiving a fabric load driven by an electric motor comprising:

means for energizing said motor to rotate said basket at a first low speed level;

means for periodically sensing the amount of moisture removed; and means for incrementally increasing the rotational speed of said basket until a predetermined condition determined from the measurement of removed moisture has occured;

whereby, moisture will be removed from said basket at said low speed level and at subsequent higher levels.

33. A control according to claim 32, including means for maintaining rotation of said basket at a given speed level until a predetermined condition has occurred.

34. A control according to claim 33, wherein said predetermined condition comprises removal of substantially all moisture removable at said speed level.

35. A control for use in an automatic washer which has a rotatable wash basket driven by an electric motor, said control comprising:

means for energizing said motor to rotate said basket;

means for periodically sensing an incremental amount of moisture removed from a fabric load within said basket; and means for terminating said spinning when said sensed incremental amount of moisture removed from said fabric falls below a predetermined value.

36. A control according to claim 35, wherein said means for periodically sensing comprises means for repeatedly accelerating said basket between a low limit speed and a high limit speed, means for measuring the time required for such accelerations and means for comparing successive required times to determine the incremented amount of moisture removed.

37. A control according to claim 35, including means for increasing basket rotational speeds incrementally to a predetermined maximum speed when said sensed incremental amount of moisture removed falls below a predetermined value, and said means for termination of spinning being effective only when said predetermined value is sensed at said maximum speed.

* * * * *